US006493424B2

(12) United States Patent
Whitham

(10) Patent No.: US 6,493,424 B2
(45) Date of Patent: Dec. 10, 2002

(54) MULTI-MODE OPERATION OF A STANDING WAVE LINEAR ACCELERATOR

(75) Inventor: Kenneth Whitham, Alamo, CA (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 0 days.

(21) Appl. No.: 09/800,214

(22) Filed: Mar. 5, 2001

(65) Prior Publication Data

US 2002/0122531 A1 Sep. 5, 2002

(51) Int. Cl.[7] ..... H01J 35/30
(52) U.S. Cl. ..... 378/137; 378/65
(58) Field of Search ..... 378/65, 119, 136, 378/137, 138; 315/5.41, 5.42; 250/396 R, 398

(56) References Cited

U.S. PATENT DOCUMENTS 4,006,422 A 2/1977 Schriber
4,024,426 A 5/1977 Vaguine
4,093,854 A * 6/1978 Turcotte et al. ..... 250/269.2
4,247,774 A 1/1981 Brooks
4,286,192 A 8/1981 Tanabe et al.
4,400,650 A 8/1983 Giebeler, Jr.
4,629,938 A 12/1986 Whitham
4,746,839 A * 5/1988 Kazusa et al. ..... 315/5.41
5,334,943 A * 8/1994 Sawada ..... 250/396 R
5,537,452 A 7/1996 Shepherd et al.
5,748,700 A 5/1998 Shepherd et al.
5,821,694 A 10/1998 Young
6,134,295 A 10/2000 Kirby et al.

* cited by examiner

*Primary Examiner*—David P. Porta

(57) ABSTRACT

The invention provides a scheme in accordance with which a linear accelerator may be operated in two or more resonance (or standing wave) modes to produce charged particle beams over a wide range of output energies so that diagnostic imaging and therapeutic treatment may be performed on a patient using the same device. In this way, the patient may be diagnosed and treated, and the results of the treatment may be verified and documented, without moving the patient. This feature reduces alignment problems that otherwise might arise from movement of the patient between diagnostic and therapeutic exposure machines. In addition, this feature reduces the overall treatment time, thereby reducing patient discomfort.

20 Claims, 3 Drawing Sheets

MULTI-MODE OPERATION OF A STANDING WAVE LINEAR ACCELERATOR

TECHNICAL FIELD

This invention relates to multi-mode operation of a standing wave linear accelerator for producing a diagnostic beam or a therapeutic beam, or both.

BACKGROUND

Radiation therapy involves delivering a high, curative dose of radiation to a tumor, while minimizing the dose delivered to surrounding healthy tissues and adjacent healthy organs. Therapeutic radiation doses may be supplied by a charged particle accelerator that is configured to generate a high-energy (e.g., several MeV) electron beam. The electron beam may be applied directly to one or more therapy sites on a patient, or it may be used to generate a photon (e.g., X-ray) beam, which is applied to the patient. An x-ray tube also may supply therapeutic photon radiation doses to a patient by directing a beam of electrons from a cathode to an anode formed from an x-ray generating material composition. The shape of the radiation beam at the therapy site may be controlled by discrete collimators of various shapes and sizes or by multiple leaves (or finger projections) of a multi-leaf collimator that are positioned to block selected portions of the radiation beam. The multiple leaves may be programmed to contain the radiation beam within the boundaries of the therapy site and, thereby, prevent healthy tissues and organs located beyond the boundaries of the therapy site from being exposed to the radiation beam.

X-ray bremsstrahlung radiation typically is produced by directing a charged particle beam (e.g., an electron beam) onto a solid target. X-rays are produced from the interaction between fast moving electrons and the atomic structure of the target. The intensity of x-ray radiation produced is a function of the atomic number of the x-ray generating material. In general, materials with a relatively high atomic number (i.e., so-called "high Z" materials) are more efficient producers of x-ray radiation than materials having relatively low atomic numbers (i.e., "low Z" materials). However, many high Z materials have low melting points, making them generally unsuitable for use in an x-ray target assembly where a significant quantity of heat typically is generated by the x-ray generation process. Many low Z materials have good heat-handling characteristics, but are less efficient producers of x-ray radiation. Tungsten typically is used as an x-ray generating material because it has a relatively high atomic number (Z=74) and a relatively high melting point (3370° C.).

The bremsstrahlung process produces x-rays within a broad, relatively uniform energy spectrum. Subsequent transmission of x-rays through an x-ray target material allows different x-ray energies to be absorbed preferentially. The high-Z targets typically used for multi-MeV radiation therapy systems produce virtually no low energy x-rays (below around 100 keV). The resultant high energy x-rays (mostly above 1 MeV) are very penetrating, a feature that is ideal for therapeutic treatment. In fact, in treatment applications, it is desirable not to have a significant amount of low energy x-rays in the treatment beam, as low-energy beams tend to cause surface burns at the high doses needed for therapy.

Before and/or after a dose of therapeutic radiation is delivered to a patient, a diagnostic x-ray image of the area to be treated typically is desired for verification and archiving purposes. The x-ray energies used for therapeutic treatment, however, typically are too high to provide high quality diagnostic images because high-energy therapeutic beams tend to pass through bone and tissue with little attenuation. As a result, very little structural contrast is captured in such images. In general, the x-ray energies that are useful for diagnostic imaging are around 100 keV and lower. High-Z targets produce virtually no x-rays in this diagnostic range. Low-Z targets (e.g., targets with atomic numbers of 30 or lower, such as aluminum, beryllium, carbon, and aluminum oxide targets), on the other hand, produce x-ray spectra that contain a fraction of low-energy x-rays that are in the 100 keV range and, therefore, are suitable for diagnostic imaging applications. See, for example, O. Z. Ostapiak et al., "Megavoltage imaging with low Z targets: implementation and characterization of an investigational system," Med. Phys., 25 (10), 1910–1918 (October 1998).

In addition to changing x-ray targets, other methods of varying the output energy of a radiation system have been proposed.

For example, U.S. Pat. No. 4,024,426 discloses a standing-wave linear accelerator that includes a plurality of electromagnetically decoupled side-cavity coupled accelerating substructures such that adjacent accelerating cavities are capable of supporting standing waves of different phases. The phase relationship between substructures may be adjusted to vary the beam energy.

U.S. Pat. No. 4,286,192 discloses a variable energy standing wave guide linear accelerator in which the radio frequency mode in a coupling cavity may be changed to reverse the field direction in part of the accelerator. In particular, the mode of a side cavity is adjusted so that the phase introduced between adjacent main cavities is changed from X to zero radians. The field reversal acts to decelerate the beam in that part of the accelerator.

U.S. Pat. No. 4,629,938 describes a standing wave linear accelerator with a side cavity that may be detuned to change the normal fixed phase shift of the main cavities adjacent to the detuned side cavity, and to decrease the electric field strength in cavities downstream from the detuned side cavity.

Still other variable energy standing wave linear accelerator schemes have been proposed.

SUMMARY

The invention features systems and methods for multi-mode operation of a standing wave linear accelerator to produce charged particle beams with different output energies. The resulting charged particle beams may be used to produce a relatively high energy therapeutic beam or a relatively low energy diagnostic beam, or both.

In one aspect, the invention features a method of generating charged particle beams of different output energy. In accordance with this method, a standing wave linear accelerator is operated in a first resonance mode to produce a first charged particle beam characterized by a first output energy, and the standing wave linear accelerator in a second resonance mode to produce a second charged particle beam characterized by a second output energy different from the first output energy.

Embodiments in accordance with this aspect of the invention may include one or more of the following features.

The first output energy preferably is suitable for performing diagnostic imaging of a patient. For example, the first output energy may be less than about 1,000–1,500 keV.

The second output energy preferably is suitable for performing therapeutic treatment of a patient. For example, the second output energy may be between about 4 MeV and about 24 MeV.

The standing wave linear accelerator preferably is operated in a non-$\pi/2$ resonance mode to produce the first charged particle beam, and the standing wave linear accelerator preferably is operated in a $\pi/2$ resonance mode to produce the second charged particle beam.

One or both of the first and second charged particle beams may be intercepted with an energy filter or an energy absorber.

In another aspect, the invention features a method of performing diagnostic imaging of a patient. In accordance with this method, a standing wave linear accelerator is operated in a non-$\pi/2$ resonance mode to produce a charged particle beam. A diagnostic beam is produced from the charged particle beam. The patient is imaged based upon passage of the diagnostic beam through the patient.

In another aspect, the invention features a system for generating charged particle beams of different output energy that includes a standing wave linear accelerator, and a controller configured to implement the above-described methods.

Among the advantages of the invention are the following.

The invention provides a scheme in accordance with which a linear accelerator may be operated in two or more resonance (or standing wave) modes to produce charged particle beams over a wide range of output energies so that diagnostic imaging and therapeutic treatment may be performed on a patient using the same device. In this way, the patient may be diagnosed and treated, and the results of the treatment may be verified and documented, without moving the patient. This feature reduces alignment problems that otherwise might arise from movement of the patient between diagnostic and therapeutic exposure machines. In addition, this feature reduces the overall treatment time, thereby reducing patient discomfort.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

Figure 1:
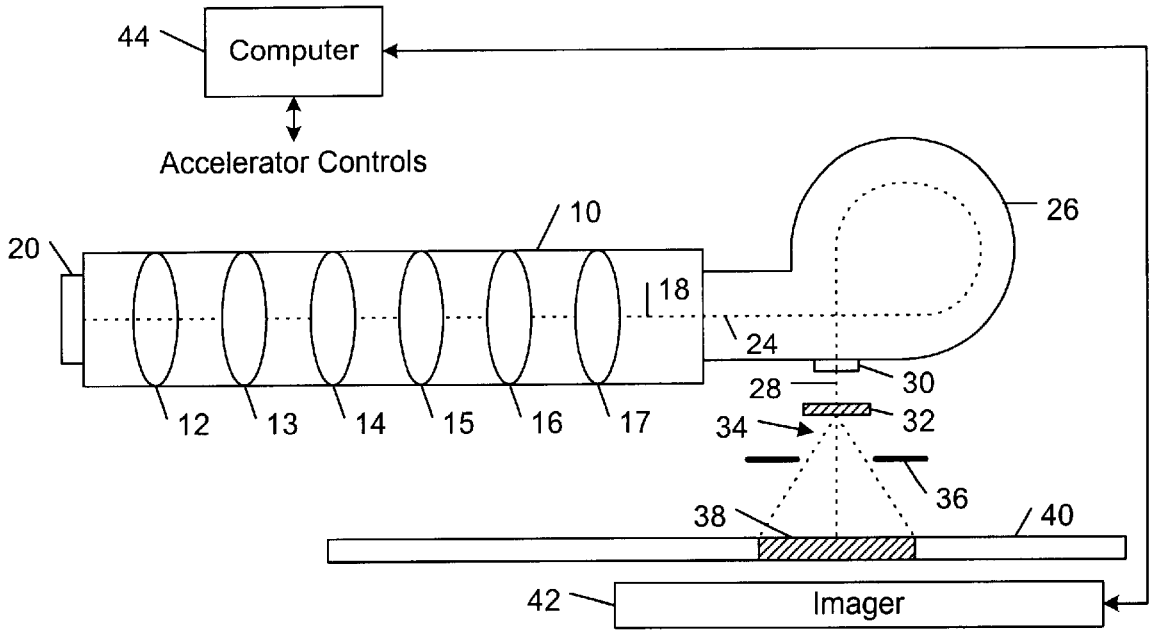
FIG. 1 (Prior Art)
FIG. 1 is a block diagram of a radiation treatment device delivering a therapeutic radiation beam to a therapy site on a patient.

Referring to FIG. 1, in one embodiment, a standing wave charged particle linear accelerator 10 for use in a medical radiotherapy device includes a series of accelerating cavities 12, 13, 14, 15, 16, 17 that are aligned along a beam axis 18. A particle source 20 (e.g., an electron gun) directs charged particles (e.g., electrons) into accelerating cavity 12. As the charged particles travel through the succession of accelerating cavities 12–17, the particles are focused and accelerated by an electromagnetic field that is applied by an external source. The resulting accelerated particle beam 24 may be directed to a magnetic energy filter 26 that bends beam 24 by approximately 270°. A filtered output beam 28 is directed through a window 30 to a target 32 that generates an x-ray beam 34. The intensity of radiation beam 34 typically is constant. One or more adjustable leaves 36 may be positioned to block selected portions of radiation beam 34 to conform the boundary of radiation beam 34 to the boundaries of a therapy site 38 on a patient 40. An imager 42 collects image data corresponding to the intensity of radiation passing through patient 40. A computer 44 typically is programmed to control the operation of leaves 36 to generate a prescribed intensity profile over the course of a treatment, and to control the operation of linear accelerator 10 and imager 42.

Figure 2:
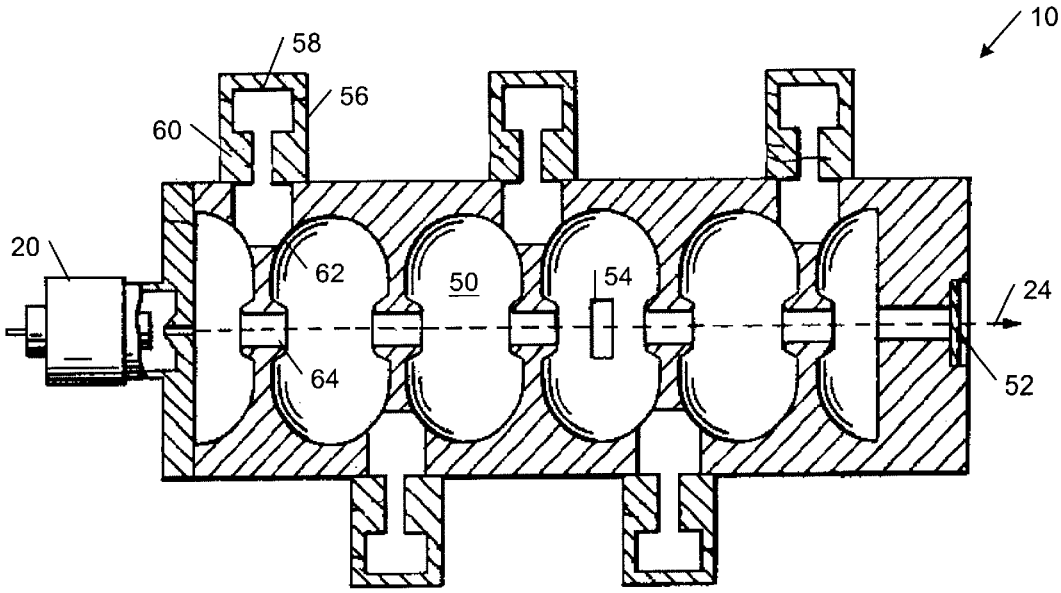
FIG. 2 (Prior Art)
FIG. 2 is a diagrammatic cross-sectional side view of a side cavity coupled standing wave linear accelerator.

Referring to FIG. 2, in one embodiment, linear accelerator 10 is implemented as a coupled cavity accelerator (e.g., a coupled cavity linear accelerator or a coupled cavity drift tube linear accelerator). In this embodiment, linear accelerator 10 includes a plurality of accelerating cavity resonators 50 that are arranged successively along beam axis 18 and are configured to accelerate charged particles within beam 24 to nearly the velocity of light. Particle source 20 forms and injects a beam of charged particles into linear accelerator 10. An output window 52, which is disposed at the downstream end of linear accelerator 10, is permeable to the high energy particle beam 24, but is impermeable to gas molecules. Linear accelerator 10 and particle source 20 typically are evacuated to a suitably low pressure (e.g., $10^{-6}$ torr) by a vacuum pump (not shown).

Linear accelerator 10 is excited with microwave energy produced by a conventional microwave source (e.g., a magnetron or a klystron amplifier) that may be connected to linear accelerator 10 by a waveguide, which may be coupled to one of the accelerating cavity resonators 50 by an inlet iris 54. The microwave source may be configured for S-band operation and the cavity resonators 50 may be configured to be resonant at S-band. In operation, the resonant microwave fields in linear accelerator 10 electromagnetically interact with the charged particles of beam 24 to accelerate the particles essentially to the velocity of light at the downstream end of linear accelerator 10. As described above, the resulting charged particle beam 24 may bombard an x-ray target to produce high energy x-rays, or may be used to irradiate patient 40 or another object directly.

A plurality of coupling cavities 56 are disposed off beam axis 18 and are configured to couple adjacent accelerating cavities 50 electromagnetically. Each coupling cavity 56 includes a cylindrical sidewall 58 and a pair of centrally disposed inwardly projecting capacitive loading members 60 that project into and capacitively load the coupling cavity 56. Each coupling cavity 56 is disposed tangentially to the accelerating cavities 50. The corners of each coupling cavity 56 intersect the, inside walls of a pair of adjacent accelerating cavities 50 to define magnetic field coupling irises 62, which provide electromagnetic wave energy coupling between the accelerating cavities 50 and the associated coupling cavities 56. The accelerating cavities 50 and the coupling cavities 56 are tuned substantially to the same frequency.

Figure 3:
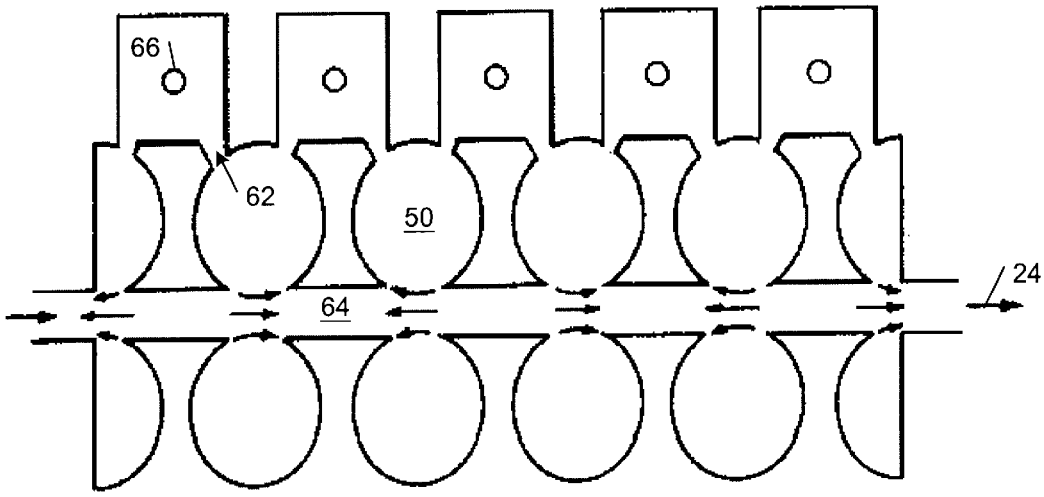
FIG. 3 (Prior Art)
FIG. 3 is a diagrammatic representation of electric field orientation in the linear accelerator of FIG. 2 operated in a $\pi/2$ resonance mode at one instant of maximum electric field.

As shown in FIG. 3, in one mode of operation, the gaps 64 between accelerating cavities 50 are spaced so that charged particles travel from one gap to the next in ½ rf cycle of the microwave source. As a result, after experiencing an accelerating field in one gap, the charged particles arrive at the next gap when the direction of the field in the next gap has reversed direction to further accelerate the charged particles. The field in each side cavity 56 is advanced in phase by $\pi/2$ radians from the preceding accelerating cavity 50 so that the complete resonant structure of linear accelerator 10 operates in a mode with $\pi/2$ phase shift per cavity (i.e., a $\pi/2$ resonance mode). Since charged particle beam 24 does not interact with side cavities 56, charged particle beam 24 experiences the equivalent acceleration of a structure with a $\pi$-radian phase shift between adjacent accelerating cavities 50. In this embodiment, the essentially standing wave pattern within linear accelerator has very small fields 66 in side cavities 56 because the end cavities also are configured as accelerating cavities 50. This feature minimizes rf losses in the non-working side cavities 56. In addition, configuring the end cavities as half cavities improves the charged particle beam entrance conditions and provides a symmetrical resonant structure with uniform fields in each accelerating cavity 50. In one embodiment, the microwave source may provide sufficient energy for linear accelerator 10 to produce a charged particle beam 24 with a maximum output energy in the range of about 4 MeV to about 24 MeV, while operating in a $\pi/2$ resonance mode.

Linear accelerator 10 also may be operated in a number of different, non-$\pi/2$ resonance (or standing wave) modes. Relative to the $\pi/2$ mode of operation, each of these other resonant modes of operation is characterized by a lower efficiency and a smaller net acceleration of charged particle beam 24. However, operation of linear accelerator 10 in each of these other resonant modes still preserves the narrow charged particle beam energy spread that is characteristic of the $\pi/2$ mode of operation. Accordingly, by operating linear accelerator 10 in a non-$\pi/2$ mode (e.g., an adjacent side mode), a high quality charged particle beam may be produced with an output energy that is lower than the maximum output energy produced by operating linear accelerator 10 in a $\pi/2$ mode. In one embodiment, a beam output energy level that is less than about 1,000–1,500 keV may be achieved.

In one embodiment, linear accelerator 10 may be operated in two or more resonance (or standing wave) modes to produce charged particle beams over a wide range of output energies so that diagnostic imaging and therapeutic treatment may be performed on patient 40 using the same device. In this way, patient 40 may be diagnosed and treated, and the results of the treatment may be verified and documented, without moving patient 40. This feature reduces alignment problems that otherwise might arise from movement of patient 40 between diagnostic and therapeutic exposure machines. In addition, this feature reduces the overall treatment time, thereby reducing patient discomfort.

Figure 4A:
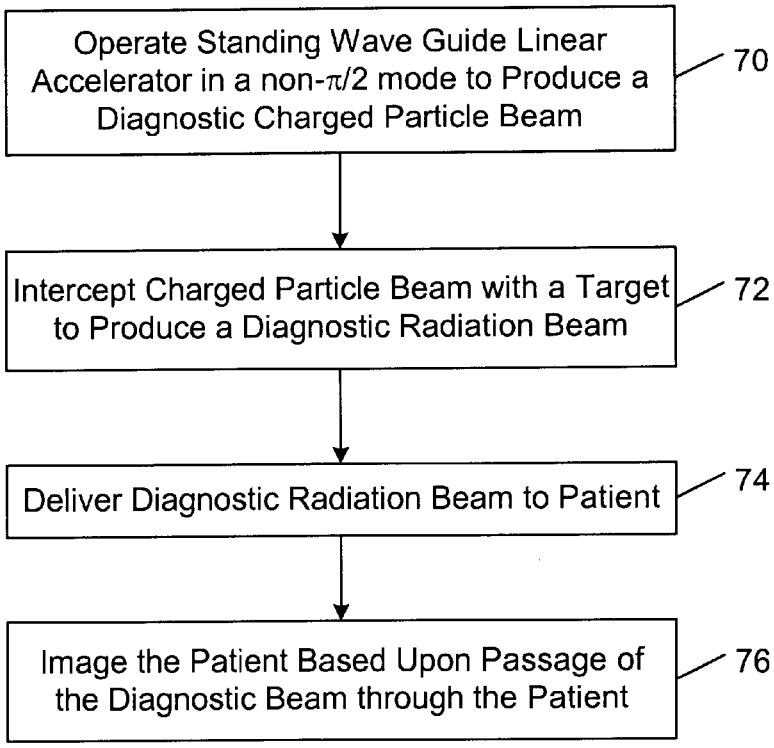
FIG. 4A is a flow diagram of a method of operating the linear accelerator in a non-$\pi/2$ resonance mode to produce a diagnostic radiation beam.

Referring to FIG. 4A, in one embodiment, linear accelerator 10 may be operated to produce a diagnostic radiation beam 34 as follows. Linear accelerator 10 is operated in a non-$\pi/2$ resonance mode to produce a diagnostic charged particle beam 28 (step 70). The diagnostic charged particle beam 28 may have an output energy level that is less than about 1,000–1,500 keV. The diagnostic charged particle beam 28 may be intercepted by target 32 to produce a diagnostic radiation beam 34 (step 72). Target 32 may be a conventional x-ray target that includes an energy filter or an energy absorber that is configured to tailor the energy level of radiation beam 34 to a desired level (e.g., on the order of about 100–500 keV). For example, target 32 may include a low-Z material (e.g., a material with atomic numbers of thirty or lower, such as aluminum, beryllium, carbon, and aluminum oxide) that produces x-ray spectra that contain a fraction of low-energy x-rays that are on the order of about 100 keV. If necessary, the energy level of diagnostic radiation beam 34 may be tailored further by raising or lowering the rf energy level supplied by the microwave source. The input charged particle beam injection current also may be adjusted to tailor the characteristics of diagnostic radiation beam 34. The resulting diagnostic radiation beam 34 may be delivered to patient 40 (step 74). Imager 42 may produce diagnostic images of patient 40 based upon passage of diagnostic radiation beam 34 through the patient (step 76). The diagnostic images may be used to diagnose patient 40 or to verify or document the results of a prior radiation treatment.

Figure 4B:
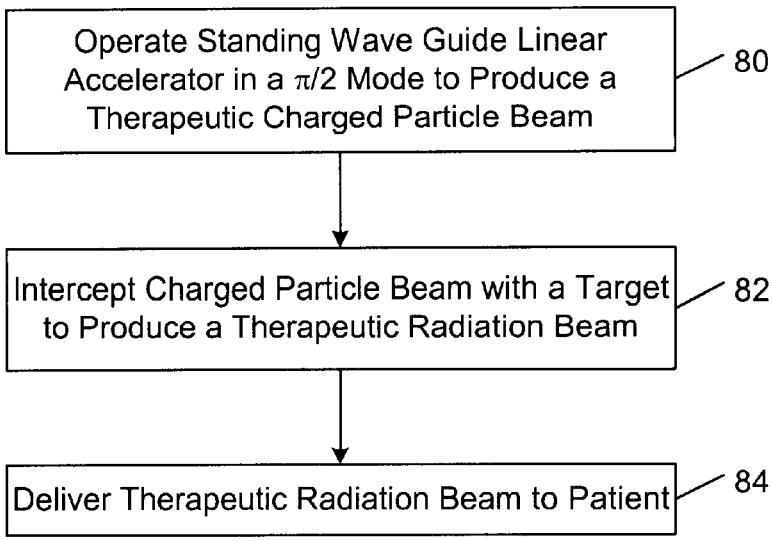
FIG. 4B is a flow diagram of a method of operating the linear accelerator in a $\pi/2$ resonance mode to produce a therapeutic radiation beam.

Referring to FIG. 4B, in one embodiment, linear accelerator 10 may be operated to produce a therapeutic radiation beam 34 as follows. Linear accelerator 10 is operated in a $\pi/2$ resonance mode to produce a therapeutic charged particle beam 28 (step 80). The therapeutic charged particle beam 28 may have an output energy level that is between about 4 MeV and about 24 MeV. The therapeutic charged particle beam 28 may be intercepted by target 32 to produce a therapeutic radiation beam 34 (step 82). Target 32 may be a conventional x-ray target that includes an energy filter or an energy absorber that is configured to tailor the energy level of therapeutic radiation beam 34 to a desired level (e.g., on the order of about 1 MeV or greater). For example, target 32 may include a high-Z material (e.g., a material with an atomic number of seventy-two or greater, such as tungsten, tantalum, gold and alloys thereof) that produces x-ray radiation that contains essentially no low-energy x-rays. If necessary, the energy level of therapeutic radiation beam 34 may be tailored further by raising or lowering the rf energy level supplied by the microwave source. The input charged particle beam injection current also may be adjusted to tailor the characteristics of therapeutic radiation beam 34. The resulting therapeutic radiation beam 34 may be delivered to patient 40 for treatment purposes (step 84).

Other embodiments are within the scope of the claims.

For example, although the above embodiments are described in connection with side coupling cavities, other forms of energy coupling (e.g., coupling cavities pancaked between accelerating cavities 50 may be used.

Still other embodiments are within the scope of the claims.

What is claimed is:

1. A method of generating charged particle beams of different output energy, comprising:

operating a standing wave linear accelerator in a first resonance mode to produce a first charged particle beam characterized by a first output energy; and operating the standing wave linear accelerator in a second resonance mode to produce a second charged particle beam characterized by a second output energy different from the first output energy.

2. The method of claim 1, wherein the first output energy is suitable for performing diagnostic imaging of a patient.

3. The method of claim 2, wherein the first output energy is less than about 1,000–1,500 keV.

4. The method of claim 3, wherein the second output energy is suitable for performing therapeutic treatment of a patient.

5. The method of claim 4, wherein the second output energy is between about 4 MeV and about 24 MeV.

6. The method of claim 1, wherein the standing wave linear accelerator is operated in a non-$\pi/2$ resonance mode to produce the first charged particle beam, and the standing wave linear accelerator is operated in a $\pi/2$ resonance mode to produce the second charged particle beam.

7. The method of claim 1, further comprising intercepting one of the first and second charged particle beams with an energy filter.

8. The method of claim 1, further comprising intercepting one of the first and second charged particle beams with an energy absorber.

9. A method of performing diagnostic imaging of a patient, comprising:

operating a standing wave linear accelerator in a non-$\pi/2$ resonance mode to produce a charged particle beam;

producing a diagnostic beam from the charged particle beam; and imaging the patient based upon passage of the diagnostic beam through the patient.

10. The method of claim 9, wherein the charged particle beam has an output energy level less than about 1,000–1,500 keV.

11. The method of claim 9, wherein the diagnostic beam is produced by intercepting the charged particle beam with an x-ray target.

12. The method of claim 9, wherein the diagnostic beam is produced by intercepting the charged particle beam with an energy filter.

13. The method of claim 9, wherein the diagnostic beam is produced by intercepting the charged particle beam with an energy absorber.

14. A system for generating charged particle beams of different output energy, comprising:

a standing wave linear accelerator; and a controller configured to operate the standing wave linear accelerator in a first resonance mode to produce a first charged particle beam characterized by a first output energy; and operate the standing wave linear accelerator in a second resonance mode to produce a second charged particle beam characterized by a second output energy different from the first output energy.

15. The system of claim 14, wherein the first output energy is suitable for performing diagnostic imaging of a patient.

16. The system of claim 15, wherein the first output energy is less than about 1,000–1,500 keV.

17. The system of claim 15, wherein the second output energy is suitable for performing therapeutic treatment of a patient.

18. The system of claim 15, wherein the standing wave linear accelerator is operated in a non-$\pi/2$ resonance mode to produce the first charged particle beam, and the standing wave linear accelerator is operated in a $\pi/2$ resonance mode to produce the second charged particle beam.

19. The system of claim 14, further comprising an energy filter constructed and arranged to intercept one of the first and second charged particle beams.

20. The system of claim 14, further comprising an energy absorber constructed and arranged to intercept one of the first and second charged particle beams.

* * * * *